US006880338B2

(12) United States Patent
Larjola

(10) Patent No.: US 6,880,338 B2
(45) Date of Patent: Apr. 19, 2005

(54) LEAD-IN STRUCTURE AND A FIXING FLANGE FOR A TURBO GENERATOR

(75) Inventor: Jaakko Larjola, Mäntyharju (FI)

(73) Assignee: High Speed Tech Oy Ltd, Helsinki (FI)

( * ) Notice: Subject to any disclaimer, the term of this patent is extended or adjusted under 35 U.S.C. 154(b) by 103 days.

(21) Appl. No.: 10/380,198

(22) PCT Filed: Sep. 5, 2001

(86) PCT No.: PCT/FI01/00767

§ 371 (c)(1),
(2), (4) Date: Mar. 13, 2003

(87) PCT Pub. No.: WO02/23014

PCT Pub. Date: Mar. 21, 2002

(65) Prior Publication Data

US 2004/0093869 A1 May 20, 2004

(30) Foreign Application Priority Data

Sep. 13, 2000 (FI) ..... 20002019

(51) Int. Cl.[7] ..... F01K 13/00
(52) U.S. Cl. ..... 60/645; 60/670
(58) Field of Search ..... 60/645, 670

(56) References Cited

U.S. PATENT DOCUMENTS

| | | | | |
|---|---|---|---|---|
| 4,105,372 A | | 8/1978 | Mishina et al. | |
| 4,253,031 A | * | 2/1981 | Frister | 290/52 |
| 4,362,020 A | * | 12/1982 | Meacher et al. | 60/657 |
| 4,558,228 A | * | 12/1985 | Larjola | 290/52 |
| 5,329,771 A | | 7/1994 | Kytömäki et al. | |
| 5,570,579 A | | 11/1996 | Larjola | |
| 5,831,341 A | * | 11/1998 | Selfors et al. | 290/52 |
| 5,870,894 A | * | 2/1999 | Woollenweber et al. | 60/607 |
| 6,046,509 A | | 4/2000 | LaBaire | |

FOREIGN PATENT DOCUMENTS

FI 66234 4/1983

OTHER PUBLICATIONS

Larjola J., Lindgren O., Vakkilainen E., "Sähköähukkalämmöstä", publ. No. D:194, 1991, Ministry of Trade and Industry, Department of Energy, Helsinki.
Jokinen T., Larjola J., Mikhaltsev I., "Power Unit for Research Submersible", proceedings of the International conference on electric ship, Istanbul, 1st Sep. 1998, p. 114–118.

* cited by examiner

*Primary Examiner*—Hoang Nguyen
(74) *Attorney, Agent, or Firm*—Venable LLP; Eric J. Franklin

(57) ABSTRACT

The invention relates to a lead-in structure for coupling of a turbo generator in a circulating process of a circulating medium. The turbo generator includes a turbine and a generator as well as possibly also a feed pump enclosed in a common casing structure. The casing structure also includes at least a first duct for hot, steam-like circulating medium entering the turbine, a second duct for circulating medium exiting the turbine, and a third duct for cooled liquid circulating medium, which, for example, enters the feed pump. The third duct includes an annular channel that is placed, preferably concentrically, around the second duct, which includes an annular channel. The first duct includes an annular channel that is placed, preferably concentrically, between the second duct and the annular channel of the third duct. The fixing flange applying the lead-in structure may include a closing valve that is controlled with a pressurized medium and that is arranged to keep the tubular channel of the second duct normally open and to keep it closed for releasing the casing element, wherein the closing valve is placed inside the tubular channel.

33 Claims, 3 Drawing Sheets

LEAD-IN STRUCTURE AND A FIXING FLANGE FOR A TURBO GENERATOR

TECHNICAL FIELD OF THE INVENTION

The invention relates to a lead-in structure for coupling a turbo generator in a circulation process of a circulating medium. The invention also relates to a fixing flange for coupling a turbo generator in the circulation process of a circulating manner in a detachable manner for maintenance.

DESCRIPTION OF BACKGROUND ART

Hermetic high-speed turbo generators are known, in which the hermetic property is based on the fact that the turbine, the generator and preferably also the feed pump are arranged on the same shaft and within a common casing, wherein external leaks e.g. from rotary shaft seals are avoided and only internal leaks between said different components are possible; in other words, the turbo generator is externally hermetic. One known turbo generator is disclosed in patent publication FI 66234, whereby the device is used to convert thermal energy into electric energy. The circulating medium used in the process is vaporized in a thermal boiler, from which it is led into a turbine, in which it expands, and further into a condenser. The turbine rotates the generator to generate a high-frequency current by a method known from e.g. asynchronous electric machines. From the condenser, the circulating medium is led into a feed pump and further back into the boiler. The operation of another known turbo generator is presented in the application publication FI 904720, in which the bearing system of the turbo generator also applies said circulating medium as a lubricant.

Into the casing of the turbo generator must be introduced the high-temperature, vaporized circulating medium from the boiler or the like and the cooled circulated medium from the condenser. Furthermore, the expanded circulated medium must be led through the casing from the turbine into a recuperator or directly into the condenser. The boiler, the condenser and the recuperator are devices separate from the turbo generator, and the connections are normally implemented with pipes. The turbo generator normally comprises a circular end flange, through which the circulating medium is led and which is fixed by a bolted joint to the cylindrical casing. The end flange, in turn, is equipped with the necessary pipe connections for fixing the pipes with e.g. a threading. For absolute tightness, the pipes are often connected to each other by welding.

A problem in the end flange is particularly the tightness of the flange joint. According to the publication by Larjola J., Lindgren O., Vakkilainen E., "Sähköä hukkalämmöstä", publ. No. D:194, 1991, Ministry of Trade and Industry, Department of Energy, Helsinki, it has also been found in practice that particularly the inlet of the vaporized circulating medium tends to leak, which is due to the thermal movement which is a problem known as such in power plant technology. In the turbo generator, said thermal movement particularly affects hot lead-in ducts of the vaporized and expanded circulating medium.

The hermetic feature is particularly important when the circulating medium used is other than water and when the power of the turbo generator is low, so that a leak would not cause considerable costs and power losses. According to the article by Jokinen T., Larjola J., Mikhaltsev I., "Power Unit for Research Submersible", proceedings of te International conference on electric ship, Istanbul, 1st September 1998, p. 114–118, the hermetic feature is particularly important under special conditions in which a leak could cause a damage of the equipment itself.

It is also known that the flange joint or other lead-in ducts and leakages are sealed with a welded joint, but it is then obvious that this makes the releasing, re-mounting and maintenance of the turbo generator considerably more difficult.

SUMMARY OF THE INVENTION

It is an aim of the present invention to eliminate the above-mentioned problems by means of a novel lead-in duct and novel structures for the fixing flange.

A considerable advantage of the invention is the hermetic connection to the rest of the process, in a manner which is as leak-proof as possible, without using difficult welded joints or expensive special sealing structures. Another advantage is that the leaks which, notwithstanding, occur due to e.g. roughness and thermal movement in the sealing surfaces, will now be guided to the channelling of the expanded circulating medium and further to the condenser, which is hardly harmful in practice. It is thus possible to avoid a harmful leak outside the system.

It is still possible to fix the pipes to the fixing flange by welding, which prevents pipe leaks. A particular advantage is that, for maintenance work, the turbo generator can now be fixed to this fixing flange in a fast, easy and detachable manner, for example by a bolted joint. Thus, the fixing flange may remain in its place and its welded joints do not need to be opened. The fixing flange and the parts connected to it are simultaneously exposed for on-site maintenance. The closing valve of the fixing flange is placed in a tubular channel where it is exposed for maintenance and from which it can be released and taken out for example to be exchanged.

BRIEF DESCRIPTION OF THE DRAWINGS

In the following, the invention will be described in more detail by using as an example some advantageous embodiments of the invention with reference to the appended drawings, in which.

MODE FOR CARRYING OUT THE INVENTION

Figure 1:
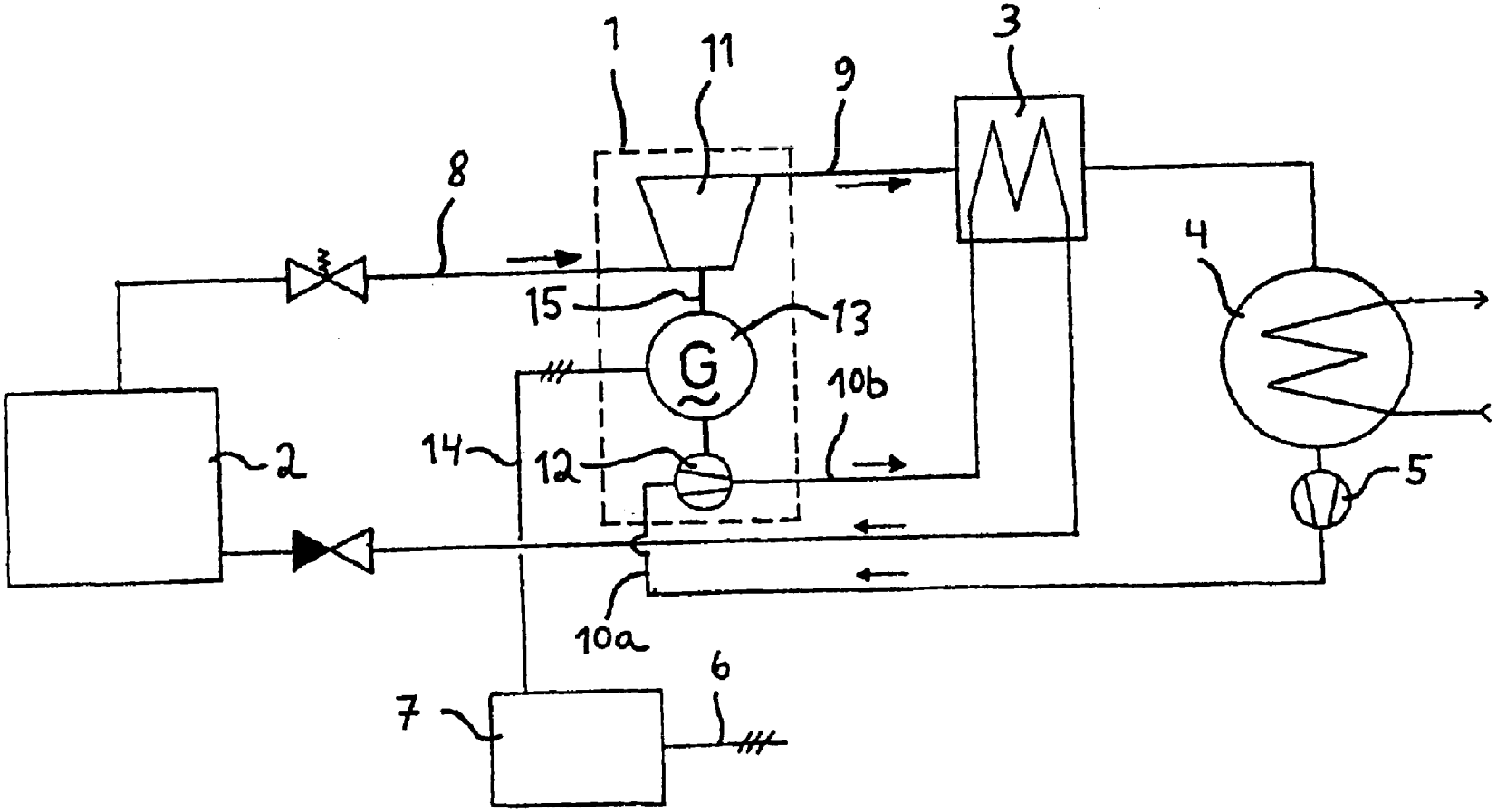
FIG. 1 shows a principle view of a prior art circulating process applying a turbo generator.

With reference to FIG. 1, the used circulating medium is vaporized by means of e.g. waste thermal energy in a boiler 2, is expanded in a turbine 11 of a turbo generator 1, is cooled in a possible recuperator 3 in case this is installed in the system, and is condensed in a condenser 4, in which the condensing agent is for example raw water or air. The feed pump 12 of the turbo generator 1 feeds the circulating medium directly or through the recuperator 3 back to the boiler 2. Normally, the system also comprises a pre-feed pump 5. The high-frequency current 14 produced by the generator 13 included in the turbo generator 1 is processed in a desired manner, e.g. to a standard current 6 suitable for a normal electric power network by means of an electric circuit 7 known as such. The generator 13 used can be a so-called asynchronous or synchronous machine, wherein the magnetization or the magnetization current for the rotor or stator of the generator 13, obtained from e.g. the circuit 7, is arranged in a corresponding manner, known as such. According to the principle of the hermetically closed turbo generator 1, the turbine 11, the rotor of the generator 13 and the feed pump 12 are mounted on a joint shaft 15, and they are also fitted inside a joint casing of the turbo generator 1. The casing, in turn, is provided with e.g. the stator of the generator 13 and the necessary bearings for the shaft 15. The casing also has the necessary lead-in ducts at least for the electric conductors 14, for the incoming vaporized circulating medium 8, for the exiting expanded circulating medium 9, and for the circulating medium coming into 10*a* and exiting from 10*b* the feed pump.

The turbo generator 1 applies, for example, a radial turbine which is known as such and which is mounted on bearings, for example thrust bearings, in which the bearing gas or liquid diaphragm used as the bearing surface is obtained from the circulating medium. Also various magnetic bearings are known. The feed pump 12 is, for example, a single-phase turbo pump whose leak flow is returned to the condenser.

Figure 2:
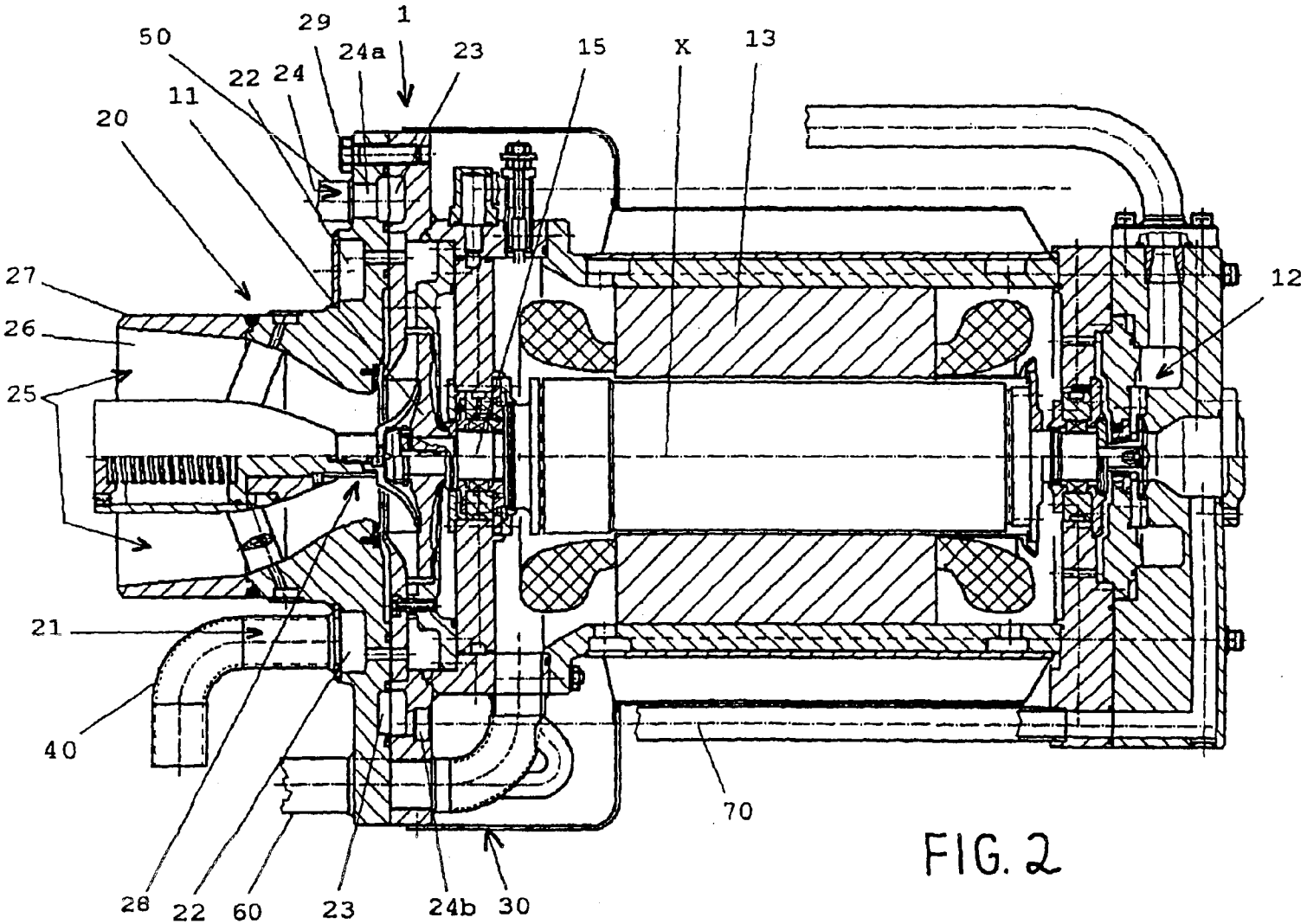
FIG. 2 shows a lead-in structure and a fixing flange according to a first advantageous embodiment of the invention, seen from the side and applied in connection with a turbo generator.

FIG. 2 shows, in more detail, a turbo generator 1 based on high-speed technology, equipped with a feed pump 12 and connected to the rest of the system with a fixing flange 20. The turbine 11, the generator 13 and the feed pump 12 are mounted on a common shaft 15, wherein they rotate around the same rotation axis X at the same speed. The gas flow rotating the turbine 11 moves through the turbine 11 towards the rotating axis X primarily in the radial direction, and it exits the turbine primarily in the axial direction towards the fixing flange 20. The liquid and gas flows 8, 9, 10*a* and 10*b* of the turbo generator 1, as shown in FIG. 1, are guided to pass through the fixing flange 20. The external hermetic property of the turbo generator 1 is achieved in that the problematic lead-in duct 21 of the hot circulating medium in vaporous, gaseous form and its annular channel 22 are enclosed in a sealed manner by a separate annular channel 23 which belongs to the lead-in duct 24 of the cold, liquid circulating medium from the condenser 4. In the sealing between the fixing flange 20 and the rest of the casing 30 of the turbo generator 1, for example o-ring seals are used for sealing the channel 23 on both sides. The parts 20 and 30 together constitute the casing structure enclosing the turbo generator 1 and penetrated by several lead-in ducts. Inside the channel 22 there is a metal o-ring seal 22*c* which may, in spite of the cooling, leak due to the remaining thermal movement. The leakage is guided into the centrally placed lead-in duct 25 for the expanded gas and into its tubular channel 26 and further into the condenser, wherein the leaked gas remains in the circulation and cannot exit the system.

Figure 3:
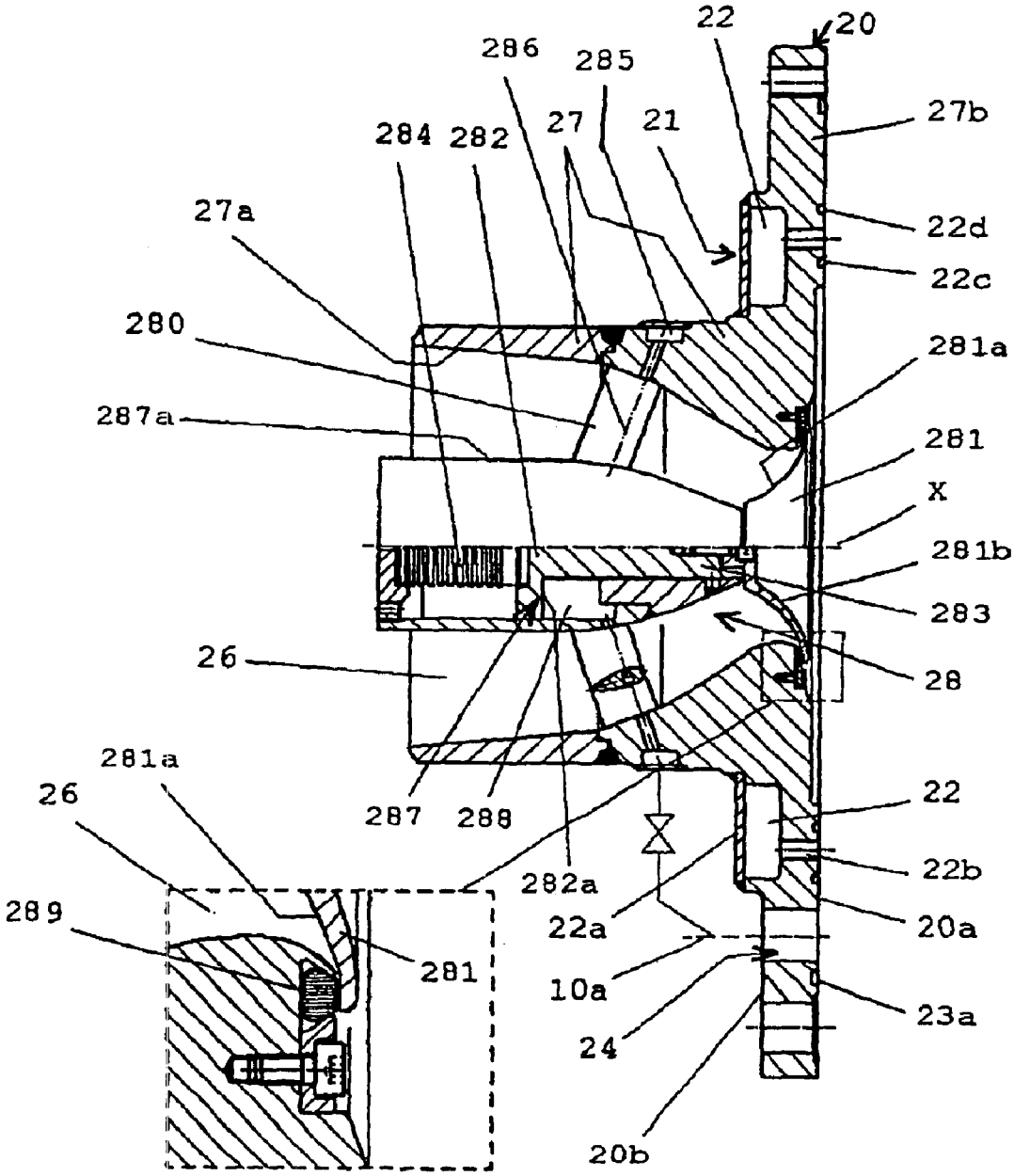
FIG. 3 shows a lead-in structure and a fixing flange according to a second advantageous embodiment of the invention in a side view.

With reference to FIG. 3, the fixing flange 20 comprises a sealing surface 20*a* which is substantially planar and which is placed towards the casing part 30 of the turbo generator 1, thereby enclosing the same. In the presented embodiment, the surface 20*a* is substantially circumferential, planar and primarily placed in a collar part 27*b* surrounding the end of the pipe part 27. The lead-in ducts 21, 24, 25 form openings on the sealing surface 20*a* which are placed in and facing corresponding openings, channels or channellings in the turbo generator 1, normally in a sealed manner. The tubular channel 26 is centrally located on the axial line X, and it is surrounded by annular channel 22 in a transverse plane. The channel 22 is made on the other side of the collar 27*b*, on the opposite surface 20*b*, and covered with a cover 22*a*, to which the pipework is also connected. The bottom of the channel 22 is thus at a distance from the level of the sealing surface 20*a*, to which several axial drillings 22*b*, distributed circumferentially, extend, for even distribution of the steam. The channel 26 and the drillings 22*b* are separated by metal o-ring 22*c*. With reference to FIG. 2, the annular channel 22 is, in turn, enclosed by an annular channel 23, which is made in the sealing surface 20*a*. The drillings 22*b* and the channel 23 are separated by an o-ring 22*d*.

The central idea is that the annular channel 23 which transfers the cold fluid with a relatively low pressure is outer than the channels 22 and 26 which transfer the hot, gaseous circulating medium. Because the lead-in duct 24 which transfers the cold, liquid circulating medium can be tightened with modern o-rings, particularly the o-ring 23*a*, to be practically hermetic, the whole system can be made externally fully hermetic. Possible leakages of the hot lead-in ducts 21, 25 leak into the system, via the channel 26 to the condenser, which is not harmful in practice. Both the incoming and returning cold, liquid circulating medium can be transferred by means of the lead-in duct 24 in both directions also to other components which are, for example, in connection with the turbo generator. Alternatively, the fixing flange 20 also comprises other lead-in ducts in addition to the lead-in duct 24.

The channel 23 is partly made in the flange 20 and partly in the casing element 30. These halves are positioned against each other to constitute the annular channel 23. Alternatively, the channel 23 is only provided in the flange 20, as a groove cut in the surface 20*a* and to be closed by means of a corresponding sealing surface in the casing element 30. The casing element 30, for example its collar part which is set against the collar part 27*b* for the attachment, is, in turn, provided with a channel or, for example, a tube extending to the feed pump 12. With reference to FIG. 3, the annular channelling is wholly formed in the corresponding sealing surface of the casing element 30, for example, as a cut groove to be closed by the surface 20*a*, wherein the cooled circulating medium touches the surface 20*a* and cools the flange 20. The inlet 24*a* and the outlet 24*b* of the circulating medium are preferably located at a distance from each other, preferably at opposite ends of the diameter. In the axial direction X, the annular channels are at a distance from each other. The channel 23 is enclosed by the o-ring 23*a*. Outermost, there is the annular fixing 29 and possibly other lead-in ducts transferring cold circulating medium with a low pressure. An o-ring 289 and the edge of a guide disc 281 are placed in a circular recess in the surface 20*a*. It is obvious that the sealings 22*b*, 22*c*, 22*d* and 23*a* with the o-rings and grooves can, alternatively, be also placed in the casing element 30. The sealing surfaces form openings which connect the lead-in ducts and which are closed by said seals.

The annular channels 22 and 23 are placed in planes which are substantially perpendicular to the axial line X, and the tube channel 26 is parallel to the axial line X. Also the sealing surface 20*a* is substantially perpendicular to the axial line X, and it may also consist of several circumferential surfaces in different planes. The annular channels 22 and 23 are preferably concentric, and each may also consist of two or more small annular channels which may also be in contact with each other to form a channel. In the presented embodiment, the channels have a rectangular cross-section, but also other shapes are possible. The diameter of the circumference of the annular channel 22 is smaller than that of the annular channel 23, and no other channels are placed therebetween. In the presented embodiment, the dimension of the annular channels is longer in the radial direction than in the axial direction. The pipes 40, 50 are placed on the same side of the collar part 27*b*, and the necessary drillings and openings are substantially parallel to the rotation axis X.

The turbo generator 1 is detached for maintenance by releasing the connection 29 between the casing element 30 and the fixing flange 20, which is normally a bolted joint. At the same time, also the electric connections of the turbo generator 1 are normally detached from their lead-in ducts, which are also implemented by closable and releasable joints in a way known as such. The electrical connections are normally provided in the casing element 30. The flange 20 can now be connected by welding directly to the recuperator or the condenser in a fixed and leak-proof manner. Thus, the fixing flange 20 constitutes a part of this equipment and a support frame for mounting of the turbo generator 1. The flange 20 is welded to this equipment, for example, by means of the tubular part 27 of the duct 25. The pipe 40 of the incoming steam can now also be fixed by welding to the duct 21, to secure the hermetic property; in a corresponding manner, also the pipe 50 leading the circulating medium into the feed pump 12 can be welded to the duct 24. In a corresponding manner, also other ducts can be placed in the flange 20, wherein also they can be welded in their place, such as the lead-in pipe 60.

In connection with maintenance work, steam and liquid pipes must be closed by means of closing valves. To eliminate separate closing valves, the channel 26 of the flange 20 is provided with a disc-like closing valve 28 to be controlled by a pressurized medium. The closing valve 28 is used to prevent draining off of the condenser and to avoid aerating of the condenser during running-in, which would otherwise cause delays. The piston of the cylinder structure of the closing valve 28 is controlled by a pressurized fluid which is introduced preferably from a pre-feed pump 5, wherein no other external pressure sources will be needed in addition to the circulating medium.

With reference to FIG. 3, the closing means of the closing valve 28 is the guide disc 281 which is connected to the rod 283 of the piston 282 of the controlled cylinder. The piston 282 and the rod 283 are centrally fitted in the channel 26 and on the rotation axis X, in whose direction the guide disc 281 reciprocates. A compressed break spring, a spring means 284 tends to move the piston 282 to its upper position shown in FIG. 2, which is an open position and in which the guide disc 281 is partly moved inside the turbo generator 1, towards the turbine 11, and placed close to the same. The curved lower surface 281*a* of the disc 281 also guides the circulating medium and turns it into the axial direction into the channel 26, wherein separate guiding and closing means are eliminated. The upper surface 281*b* facing the turbine 11 is concave. The guide disc 281 of the closing valve 28 thus forms a substantial part of the turbo generator 1. Before releasing the turbo generator 1 and opening the flange 20, pressurized circulating fluid is let from the pre-feed pump into the channel 285 which is, for example, an annular channel encircling the tubular part 27. The inner surface 27*a* of the tubular part 27 is designed to guide the circulating medium, wherein the diameter of the pipe channel 26 gradually increases to a constant. The tubular part 27 may consist of one or more parts attached to each other. From the channel 285, there is a connection 286 to the tubular part 27 and to the channel 26, to the pressurized space 288 of the centrally fitted cylinder structure 287.

In the presented embodiment, the cylinder structure 287 is a single action cylinder, in which the space on the piston side, where also the break spring 284 is located, is connected to the channel 26. The outer surface 287*a* of the cylinder structure 287 is designed to guide the gas. The pressure effect of the pressurized space 288 is active as a force on the annular surface area 282*a* of the piston 282 on the side of the piston rod 283, and it tends to move the piston 282 to the closed position of FIG. 3, in which the shortened break spring 284 is compressed. The force effect is opposite to the opening force effect of the break spring 284.

The guide disc 281 of the closing valve 28; attached to the end of the arm 283, is placed at its edge against the o-ring sealing 289, on the side of the lower surface 281*a*, and it tightly closes the channel 26 to the condenser or recuperator. When the turbo generator is released, there is an underpressure in the condenser, and at the same time, the closing air pressure effective on the guide disc 281 increases the tightness of the closing valve 28. When the pressure of the pressure space 288 is removed, for example by closing the connection to the circulating fluid tube 10*a* by means of a valve and/or possibly by coupling the pressure space to a lower pressure, such as an air space, the piston 282 moves the guide disc 281, forced by the break spring 284, back to the position shown in FIG. 2. Thus, the gas has free access from the turbine 11 of the turbo generator 1 to the condenser or recuperator via the channel 26. According to an advantageous embodiment, the connection 286 comprises one or more radial drillings, wherein guide blades 280 in the channel 26 are provided with one or more drillings. At the same time, the one or more blades 280 support the structure 287.

The invention is not limited solely to the above-presented embodiment, but it can be modified within the scope of the appended claims.

What is claimed is:

1. A lead-in structure for coupling a turbo generator to a circulation process of a circulating medium, the turbo generator comprising a turbine and a generator enclosed in a common casing structure, and wherein casing structure comprises at least a first duct for hot, steam-like circulating medium entering the turbine, a second duct for circulating medium exiting the turbine, and a third duct for cooled liquid circulating medium, wherein the third duct comprises an annular channel, through which circulating medium is led to and, which is placed around the second duct, and wherein the first duct comprises an annular channel, through which circulating medium is led into the turbine for the supply and which is placed between the second duct and the annular channel of the third duct.

2. The lead-in structure according to claim 1, wherein the casing structure comprises a casing element and a fixing flange to be fixed thereto, which is arranged to close the casing element hermetically and to fix the turbo generator in its position, wherein the casing element and the fixing flange comprise sealing surfaces placed against each other, wherein one or several annular channels consist of an annular groove made in one sealing surface, closed by another sealing surface, or of annular grooves made in both sealing surfaces which are placed against each other to form a uniform annular channel.

3. The lead-in structure according to claim 2, wherein the annular channel of the first duct is placed in the fixing flange and at a distance from the sealing surface, to which the circulating medium is arranged to be led via drillings from the annular channel.

4. The lead-in structure according to claim 2, wherein the sealing surface is provided with a first sealing between the second duct and the first duct, a second sealing between the first duct and the third duct, and a third sealing around the third duct.

5. The lead-in structure according to claim 2, wherein the circulating medium is arranged to be fed into the annular channel of the third duct via a first drilling extending through the fixing flange and off from the annular channel via a second opening extending through the casing element, wherein said openings are further placed at a distance from each other.

6. The lead-in structure according to claim 2, wherein the second duct comprises a tubular channel, and that the fixing flange comprises a closing valve which can be controlled by pressurized medium and which is arranged to keep the tubular channel of the second duct normally open and to keep it closed for releasing of the casing element, wherein the closing valve is placed inside the tubular channel.

7. The lead-in structure according to claim 2, wherein the fixing flange comprises a tubular part in which the second duct is placed, and a collar part placed around the end of the tubular part, in which at least the first duct and at least the third duct are placed.

8. The lead-in structure according to claim 6, wherein the closing valve comprises a guide disc which can be moved back and forth and which is arranged, in its first position, to close the tubular channel in a sealed manner and, in its second position, to guide, by its shape, the circulating medium into the tubular channel, and a cylinder structure which is controlled by a pressurized medium and which is arranged to move the guide plate fixed thereto.

9. The lead-in structure according to claim 2, wherein the second duct comprises a tubular channel, and that the annular channels are placed on one or several parallel planes which are substantially perpendicular to the axial tubular channel of the second duct.

10. The lead-in structure according to claim 1, wherein the second duct comprises a tubular channel, and that the annular channels are placed on one or several parallel planes which are substantially perpendicular to the axial tubular channel of the second duct.

11. The lead-in structure according to claim 1, wherein the circulating medium is arranged to be fed into the annular channel of the third duct via a first drilling extending through the fixing flange and off from the annular channel via a second opening extending through the casing element, wherein said openings are further placed at a distance from each other.

12. The lead-in structure according to claim 1, wherein the second duct comprises a tubular channel, and that the fixing flange comprises a closing valve which can be controlled by pressurized medium and which is arranged to keep the tubular channel of the second duct normally open and to keep it closed for releasing of the casing element, wherein the closing valve is placed inside the tubular channel.

13. The lead-in structure according to claim 12, wherein the closing valve comprises a guide disc which can be moved back and forth and which is arranged, in its first position, to close the tubular channel in a sealed manner and, in its second position, to guide, by its shape, the circulating medium into the tubular channel, and a cylinder structure which is controlled by a pressurized medium and which is arranged to move the guide plate fixed thereto.

14. The lead-in structure according to claim 13, wherein the closing valve is supported to the tubular channel by one or more guide blades, wherein the pressurized medium is led to the closing valve via a drilling made in one or more of the guide blades.

15. The lead-in structure according to claim 13, wherein the closing valve is arranged to close and remain closed when moved by the force effect of the pressure of the circulating medium used as a pressurized medium, and is arranged to open and remain open when moved by the force effect of a spring means.

16. The lead-in structure according to claim 15, wherein the closing valve is supported to the tubular channel by one or more guide blades, wherein the pressurized medium is led to the closing valve via a drilling made in one or more of the guide blades.

17. The lead-in structure according to claim 12, wherein the closing valve is supported to the tubular channel by one or more guide blades, wherein the pressurized medium is led to the closing valve via a drilling made in one or more of the guide blades.

18. The lead-in structure according to claim 1, wherein the fixing flange comprises a tubular part in which the second duct is placed, and a collar part placed around the end of the tubular part, in which at least the first duct and at least the third duct are placed.

19. A fixing flange for coupling a turbo generator in a detachable manner to the circulating process of a circulating medium, for maintenance, wherein the fixing flange comprises at least a first duct for hot, steam-like circulating medium entering the turbine, at least a second duct for circulating medium exiting the turbine, and at least a third duct for cooled liquid circulating medium, wherein the third duct comprises an annular channel, through which circulating medium is led to and which is placed around the second duct, and wherein the first duct comprises an annular channel, through which circulating medium is led to the turbine for supply, and which is placed between the second duct and the annular channel of the third duct.

20. The fixing flange according to claim 19, wherein the second duct comprises a tubular channel, and that the fixing flange comprises a closing valve which can be controlled by a pressurized medium and which is arranged to keep the tubular channel of the second duct normally open and to keep it closed for releasing of the turbo generator, wherein the closing valve is placed inside the tubular channel.

21. The fixing flange according to claim 19, wherein the fixing flange comprises a sealing surface which is placed towards the turbo generator, wherein the sealing surface is provided with an annular open groove which, closed by the turbo generator, forms the annular channel of the third duct, and that the fixing flange comprises a circumferential set of drillings which extend to the sealing surface from the annular channel of the first duct, whose diameter is smaller than the diameter of the annular channel of the third duct.

22. The fixing flange according to claim 20, wherein the fixing flange comprises a sealing surface which is placed towards the turbo generator, wherein the sealing surface is provided with an annular open groove which, closed by the turbo generator, forms the annular channel of the third duct, and that the fixing flange comprises a circumferential set of drillings which extend to the sealing surface from the annular channel of the first duct, whose diameter is smaller than the diameter of the annular channel of the third duct.

23. The lead-in structure according to claim 1, wherein the annular channel of the third duct is placed concentrically around the second duct.

24. The lead-in structure according to claim 1, wherein the annular channel of the first duct is placed concentrically between the second duct and the annular channel of the third duct.

25. The lead-in structure according to claim 1, wherein the turbo generator comprises a feed pump enclosed in the common casino structure.

26. The lead-in structure according to claim 25, wherein the circulating medium is led to the feed pump for the supply through the annular channel of the third duct.

27. The lead-in structure according to claim 25, wherein the cooled liquid circulating medium is led to the feed pump through the third duct.

28. The lead-in structure according to claim 9, wherein the axial tubular channel of the second duct is placed on the common rotating axis of the turbo generator.

29. The lead-in structure according to claim 10, wherein the axial tubular channel of the second duct is placed on the common rotating axis of the turbo generator.

30. The fixing flange according to claim 19, wherein the annular channel of the third duct is placed concentrically around the second duct.

31. The fixing flange according to claim 19, wherein the annular channel of the first duct is placed concentrically between the second duct and the annular channel of the third duct.

32. The fixing flange according to claim 19, wherein the cooled liquid circulating medium is led to a feed pump through the third duct.

33. The fixing flange according to claim 32, wherein the circulating medium is led to the feed pump for supply through the annular channel of the third duct.

* * * * *